United States Patent [19]

Monsheimer et al.

[11] 4,344,762

[45] Aug. 17, 1982

[54] SOAKING METHOD

[75] Inventors: Rolf Monsheimer, Darmstadt; Ernst Pfleiderer, Darmstadt-Arheilgen, both of Fed. Rep. of Germany

[73] Assignee: Röhm GmbH, Darmstadt, Fed. Rep. of Germany

[21] Appl. No.: 201,048

[22] Filed: Oct. 27, 1980

[30] Foreign Application Priority Data

Nov. 3, 1979 [DE] Fed. Rep. of Germany ..... 2944461

[51] Int. Cl.[3] ..... C14C 1/04

[52] U.S. Cl. ..... 8/94.18; 435/265

[58] Field of Search ..... 8/94.18; 435/265

[56] References Cited

U.S. PATENT DOCUMENTS

| | | | |
|---|---|---|---|
| 2,033,163 | 3/1936 | Wallerstein et al. | 435/265 |
| 2,212,750 | 8/1940 | Pfannmuller et al. | 435/265 |
| 3,986,926 | 10/1976 | Monsheimer et al. | 195/6 |
| 4,220,724 | 9/1980 | Berg | 435/265 |

FOREIGN PATENT DOCUMENTS

| | | |
|---|---|---|
| 288095 | 11/1914 | Fed. Rep. of Germany . |
| 2059453 | 12/1970 | Fed. Rep. of Germany . |
| 2301591 | 7/1974 | Fed. Rep. of Germany . |
| 452630 | 8/1936 | United Kingdom . |
| 455603 | 10/1936 | United Kingdom . |
| 455697 | 10/1936 | United Kingdom . |
| 1450231 | 9/1976 | United Kingdom . |
| 128096 | 9/1960 | U.S.S.R. . |

OTHER PUBLICATIONS

Fermente, Hormone, Vitamine, vol. I, Georg Thieme Verlag, Stuttgart, 1959, pp. 301-302.
Chem. Abstrs. 84, 32623f54, 166290.
Chem. Abstr. 54, 23393.
Chem. Abstr. 61, 851.
Chem. Abstr. 75, 65321y.
Kirk-Othmer, Encyclopedia of Chemical Technology, vol. 8, Interscience (1952), pp. 294-295.
Chem. Abstr. 52, 17771.
Chem. Abstr. 59, 11769.

*Primary Examiner*—Maria Parrish Tungol
*Attorney, Agent, or Firm*—Curtis, Morris & Safford

[57] ABSTRACT

What is disclosed is a method for soaking preserved skins or hides adaptable to the preparation of leather which comprises soaking said skins or hides in an aqueous bath containing a compound selected from the group of compounds of the formula

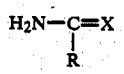

and acid addition salts thereof, wherein R taken alone is —H, —$NH_2$, —$CH_3$, or —NHCN, X taken alone is =O, =S, or =NH, and R and X taken together form a five- or six-membered heterocyclic ring having conjugated double bonds and containing only nitrogen as a hetero atom.

14 Claims, No Drawings

SOAKING METHOD

The present invention relates to a method for soaking preserved skins or hides adaptable to the preparation of leather.

The soaking of raw hides is the first task of the so-called beamhouse. Water is removed from the skins and the hides by the preserving process using salts, and during storage. Because of this, the skins become harder. It is the task of the soaking process to cleanse the raw hides of adhering impurities, to remove the preservative salt and other preserving agents from the skin, to dissolve water-soluble proteins and proteins which are soluble in neutral salts at least partially from the skin, and to return the skin as much as possible to its original condition of swelling.

By immersion and movement in water, the soaking process provides for dissolving out salts from the skin fiber structure and for rehydrating the fibers. The matter of swelling is to be judged somewhat differently according to the nature of the preservation of the skin (i.e. whether fresh, salted, dry-salted, or dried). Technical problems which occur in the soaking process are for the most part related to the effect of accompanying microorganisms, particularly bacteria. On rehydration of the skin, the effect of germs can again become evident. A majority of these germs have a strongly proteolytic activity. As a first approximation, the danger of bacterial damage to the skin is the greater, the dirtier and the more poorly preserved the skin is, the more impure the soaking water is, the higher the softening temperature is, and the longer is the duration of the soaking process. [cf. E. Stather in Gerbereichemie und Gerbereitechnologie ("Tanning Chemistry and Tanning Technology") 4th Edition, Akademi-Verlag, Berlin 1967 pages 155–165].

The technical considerations and practical goals thus are in the direction of reducing the temperature and the length of the soaking process. A method for the soaking of skins and hides at a pH between 10 and 12 in the presence of bacterial proteinases or fungus proteinases whose activity maximum towards casein is at a pH value between 10 and 12 is known in the prior art.

An earlier proposal to accelerate the soaking process by the addition of controlled amounts of tryptic enzymes with flawless preservation of hair and wool has found only slight acceptance in practice according to F. Stather (loc. cit. page 159).

Further, it has proved useful to add surface active wetting agents of the most different compositions to soaking baths, both for salted skins as well as for dried skins. By the use of "wetting agents", the surface tension of the water with respect to the skin is reduced and wetability is thus increased.

For the most part, these materials are aliphatic or aromatic sulfuric acid esters or sulfonic acids and their salts, hydroaromatic compounds, and aliphatic and aromatic amines and their salts which accelerate the soaking process when added to water (F. Stather, loc. cit.).

The soaking processes of the state of the art nevertheless are not fully satisfactory from various points of view. In order to avoid damage by bacterial attack, the soaking period should be as short as possible. Simultaneously, however, care must be taken during the soaking process to avoid fiber adhesion caused by non-fibrillary protein.

It has now been found that the step of soaking skins and hides can be considerably improved if compounds of the general formula

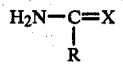

are added to the aqueous bath, wherein R taken alone is —H, —$NH_2$, —$CH_3$, or —NHCN, X taken alone is =O, =S, or =NH, or X taken together with R forms a five- or six-membered ring which has conjugated double bonds (i.e. partially hydrogenated rings are excluded), contains only nitrogen as a hetero atom, and preferably contains further amino groups as substituents. Alternatively, acid addition salts derived from these compounds can be used.

Also, several compounds of the aforementioned formula can be used in combination.

As compounds of the formula, urea, guanidine, dicyandiamide, melamine, and the acid addition salts derived therefrom should be especially mentioned, as well as thiourea, thioacetamide, acetamide, formamide, cyanourea, aminopyridine, aminopyrimidine, aminotriazole, aminoimidazole, and aminoindole.

Primarily, acid addition salts are employed of those compounds of the formula given earlier which per se react basically such as compounds having the structural unit

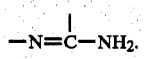

Acids suitable for the formation of acid addition salts are particularly mineral acids, such as hydrochloric acid and sulfuric acid, but also organic acids such as acetic acid, propionic acid, and the like. The concentration of the compounds of the aforementioned formula in the soaking batch can be between 0.01 and 0.25 mol per liter, preferably between 0.05 and 0.20 mol per liter, and a particularly preferred range is between 0.075 and 0.175 mol per liter.

Otherwise, the process according to the present invention can be carried out by extensively following prior art soaking processes.

The soaking method according to the invention can, for example, be carried out in such a way that salted skin materials are introduced into soaking water to which one or more compounds of the aforementioned formula, preferably in the indicated concentrations, has been added or is added during the course of the soaking process. The soaking method can be carried out in the apparatus conventional for such processes, for example in a mixer, vat, tanning machine, or drum.

The soaking method is supported and accelerated by mechanical agitation. The soaking water can, further, contain surface active agents known in the art and, particularly, fat emulsifying additives such as fatty alcohol sulfates, in the usual concentrations. The soaking method according to the present invention can be carried out at pH values between 9 and 11, preferably between 9.2 and 10.5.

In a preferred embodiment of the method, the soaking method can be carried out in a bath which, in addition to compounds of the aforementioned formula, also contains enzymes suitable for the soaking process. Preferably, these are proteolytic enzymes. The combination of compounds of the aforementioned formula together with alkaline proteinases is particularly preferred.

The pH value and other boundary conditions are in such a case suitably adapted to the activity requirements of the enzymes, in which case the previously mentioned precautions concerning the softening process must be observed.

The use, according to the invention, of compounds of the aforementioned formula togther with alkaline proteinases in a pH region between 9 and 11 is particularly preferred, wherein, as proteinases, principally serine proteinases are considered. By the term "serine proteinases" is to be understood that group of animal and bacterial endopeptidases having a serine residue in a catalytically active center (cf. Lexikon Biochemie, Verlag Chemie Weinheim, 1976, pages 512–513). Above all, proteases of the bacillus type should be mentioned, for example *B. subtilis, B. licheniformis, B. firmus, B. alcalophilus, B. polymixa, B. mesenthericus,* inter alia. In general, one can start with an enzyme activity which is at a value between 8,000 and 10,000 Loehlein-Volhard units (LVU) per gram of enzyme.

In general, amounts of proteinase between 0.05 and 0.5 percent, preferably from 0.08 to 0.275 percent and particularly preferably between 0.10 and 0.25 percent by weight of the skins and hides in their preserved condition (raw weight), suffice in the method according to the invention. The advantages of the method according to the invention are noticeable, inter alia, in a surprisingly short softening time for the method.

Thus, in general, 2 to 4 hours are sufficient in order to obtain soaked products of outstanding quality. In this case, the bath temperature can be maintained in a region from 25° C.–27° C., although self-evidently, temperatures below this value can be used according to the method. If higher temperatures are used, the aforementioned risk of increased bacterial growth must be taken into consideration.*

*With air dried and tough skin (e.g. goat skins of Chinese or Pakistani origin) the soaking process may take up to twice the time indicated above.

According to the invention, skins softened over their entire area and in which fiber adhesion is avoided are obtained after a surprisingly short soaking period. At the same time, the swelling which is observed and which is desired effects a loosening of the fibrils of the structural protein.

The use of the method according to the invention further has very considerable positive effects on subsequent method steps in the beamhouse. Thus, in the following liming, the appearance of the feared grain contraction is as good as completely excluded. Further, the use of the method according to the invention assists a more uniform and more rapid diffusion of the liming chemicals. As a result, the desired hair loosening already begins after the expiration of from 1 to 2 hours. Even for heavy raw goods, a uniform opening of the hide structure is maintained.

Further, it must be viewed as extremely surprising that there is a mutual strengthening of the effect of the enzymes and the effect of the compounds of the aforementioned formula. As a result of this synergistic effect, it is possible to keep the enzyme dosage in the order of magnitude of 50 percent of the amount of enzyme normally added, with improved efficacy.

According to the present invention, known additives such as activators, stabilizers, and optional buffers can be added to the enzymatic batches in the soaking method. The proteolytic efficiency of enzymes is conventionally determined according to the Anson hemoglobin method [M. L. Anson J. Gen. Physiol. 22, 79 (1939) or according to the Loehlein-Volhard method [die Loehlein-Volhard'sche Methode zur Bestimmung der proteolytischen Aktivitaet ("The Loehlein-Volhard Method for the Determination of Proteolytic Activity"), Gerbereichem. Taschenbuch, Dresden-Leipzig, 1955] as LVU (Loechlein-Volhard-units). One Loehlein-Volhard unit is that amount of enzyme which, under the specific conditions of the method, digests 1.725 mg of casein.

Preferably, the use of enzymes of Aspergillus and/or Streptomyces type is preferred according to present invention. As exemplary can be mentioned *Aspergillus oryzae, A. flavus, A. saitoi, A. parasiticus,* as well as *Streptomyces griseus,* inter alia. The use of several enzymes in combination can be particularly advantageous, for example the use of alkaline bacterial proteinases concurrently with alkaline fungal proteinases within the aforementioned amounts.

A better understanding of the present invention and of its many advantages will be had by referring to the following specific Examples, given by way of illustration.

EXAMPLE 1

1,000 kg of salted ox hides in the 25–29 ½ kg weight class are first washed for two hours in 100 percent of water at an inlet temperature of 30° C. in order to remove preservative salt. The hides are agitated for 20 minutes at the beginning and once again at the end. Then the bath is discarded.

Soaking follows in a new bath with 100 percent of water at an inlet temperature of 28° C. and 1.0 percent of dicyandiamide. The soaking process takes four hours. Every hour the batch is turned for 20 minutes. Hair loosening and opening of the hide structure can subsequently be carried out in the same bath. The pH value of the bath is 10.5 at the beginning of the soaking and 9.8 at the end.

The skins are uniformly softened over their entire area after four hours and, on manual testing for the soaking effect, exhibit no adhesion of the fiber structure. In all cases, the percentages are based on the salt weight of the skins.

EXAMPLE 2

1,000 kg of salted, red-variegated, south German calf skins in the 5.0–7.5 kg weight class are first washed for two hours in a drum for removal of preservative salts. Thereafter, soaking follows with 200 percent of water having an inlet temperature of 28° C. and 3.0 percent of melamine. The soaking period is two hours long. The materials are drummed for 20 minutes of each hour. The pH value of the bath at the beginning is 10.5 and is 10.2 at the end.

After conclusion of the soaking, liming is carried out in the same bath. The skins are uniformly softened and show no hair loosening, nor is any putrefaction indicated by the development of odor.

The percentages pertain to the salt weight of the skins.

EXAMPLE 3

1,000 kg of dried Chinese goat skins are softened in a vat with the following bath, based on the dry weight of the skins:

200 percent of water (30° C. inlet temperature),
1.5 percent of urea, and
0.24 percent of alkaline bacterial proteinase from *Bacillus subtilis* (9,000 LVU).

At the beginning of the soaking, the bath is agitated for one or two revolutions in order to distribute the chemicals. In order to avoid breaking the dried skins, increased agitation should first be begun one or two hours after the initiation of the soaking process.

The total soaking time is from 8 to 10 hours. Before liming, the batch should be agitated for one to two hours. Liming can be carried out thereafter in the same bath.

At the end of the soaking, the skins have reached a condition like that prior to preservation. They are uniformly soaked, exhibit no loosening of hair, and adhesion of the fibers—as evidenced by manual testing—is avoided.

The pH value of the bath at the beginning of the soaking process is 10.5 and is 9.2 at its end.

EXAMPLE 4

1,000 kg of salted pigskins are first washed for one hour in a vat with water at 25° C. Subsequently, defatting follows.

Next, the skins are softened for six hours in a vat with:
150.0 percent of water, (28° C. inlet temperature),
0.5 percent of urea,
0.3 percent of guanidine hydrochloride,
0.06 percent of alkaline bacterial proteinase from *Bacillus firmus* (9,000 LVU), and
0.06 alkaline fungus proteinases from *Aspergillus oryzae* (9,000 LVU).

The batch is agitated for 20 minutes of every hour. The pH value of the soaking bath is 10.2 at the beginning and 9.7 at the end. The skins are thoroughly softened.

In case it is desired to recover the bristles, the skins can be debristled mechanically. If no value is laid on recovery of the bristles, the pigskins can be limed in the soaking bath.

The percentage figures pertain to the weight of the salted pigskins.

Instead of dicyandiamide, in example 1 a corresponding amount of thiourea, thioacetamide, formamide, cyanourea, aminopyridine, aminopyrimidine, aminotriazole, aminoimidazole, or aminoindole can be used with comparable good results.

What is claimed is:

1. A method for soaking preserved skins or hides adaptable to the preparation of leather which consists essentially of soaking said skins or hides in an aqueous bath having a pH between 9 and 11 and consisting essentially of water and a compound selected from the group of compounds of the formula

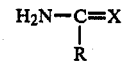

and acid addition salts thereof, wherein R taken alone is —H, —$NH_2$, —$CH_3$, or —NHCN, X taken alone is =O, =S, or =NH, and R and X taken together form a five- or six-membered heterocyclic ring having conjugated double bonds and containing only nitrogen as a hetero atom.

2. The method as in claim 1 wherein said compound is a member selected from the group consisting of urea, guanidine, dicyandiamide, acid addition salts of these compounds, and melamine.

3. The method as in claim 1 wherein said aqueous bath contains from 0.01 mol to 0.25 mol of said compound per liter of said aqueous bath.

4. The method as in claim 1 wherein said aqueous bath contains from 0.05 mol to 0.20 mol of said compound per liter of said aqueous bath.

5. The method as in claim 1 wherein said skins or hides are soaked in said aqueous bath for 2 to 4 hours.

6. A method for soaking preserved skins or hides adaptable to the preparation of leather which consists essentially of soaking said skins or hides in an aqueous bath hving a pH between 9 and 11 and consisting essentially of water, a poteolytic enzyme, and a compound selected from the group of compounds of the formula

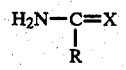

and acid addition salts thereof, wherein R taken alone is —H, —$NH_2$, —$CH_3$, or —NHCN, X taken alone is =O, =S, or =NH, and R and X taken together form a five- or six-membered heterocyclic ring having conjugated double bonds and containing only nitrogen as a hetero atom.

7. The method as in claim 6 wherein said enzyme is a serine proteinase.

8. The method as in claim 6 wherein said enzyme is an alkaline proteinase.

9. The method as in claim 7 wherein said alkaline proteinase is a serine proteinase.

10. The method as in claim 6 wherein said aqueous bath contains from 0.05 to 0.5 percent of said enzyme, by weight of the preserved skins or hides being treated.

11. The method as in claim 6 wherein said compound is a member selected from the group consisting of urea, guanidine, dicyandiamide, acid addition salts of these compounds, and melamine.

12. The method as in claim 6 wherein said aqueous bath contains from 0.01 mol to 0.25 mol of said compound per liter of said aqueous bath.

13. The method as in claim 6 wherein said aqueous bath contains from 0.05 mol to 0.20 mol of said compound per liter of said aqueous bath.

14. The method as in claim 6 wherein said skins or hides are soaked in said aqueous bath for 2 to 4 hours.

* * * * *